US011794510B2

(12) United States Patent
Nottingham, Jr.

(10) Patent No.: US 11,794,510 B2
(45) Date of Patent: Oct. 24, 2023

(54) DOUBLE-LOCKING CLICKER MECHANISM AND USES THEREOF

(71) Applicant: Lee Vig Nottingham, Jr., Hazelhurst, MS (US)

(72) Inventor: Lee Vig Nottingham, Jr., Hazelhurst, MS (US)

( * ) Notice: Subject to any disclaimer, the term of this patent is extended or adjusted under 35 U.S.C. 154(b) by 37 days.

(21) Appl. No.: 17/452,432

(22) Filed: Oct. 27, 2021

(65) Prior Publication Data

US 2023/0127350 A1 Apr. 27, 2023

(51) Int. Cl.
*B43K 24/08* (2006.01)
*B43K 5/00* (2006.01)

(52) U.S. Cl.
CPC ..... *B43K 24/082* (2013.01); *B43K 5/005* (2013.01)

(58) Field of Classification Search
CPC ..... B43K 24/04; B43K 24/082
See application file for complete search history.

(56) References Cited

U.S. PATENT DOCUMENTS

| | | | | |
|---|---|---|---|---|
| 2,722,914 | A * | 11/1955 | Aversa | B43K 24/08 30/162 |
| 3,424,536 | A | 1/1969 | Dottlinger | |
| 3,709,619 | A | 1/1973 | Zepell | |
| 5,152,626 | A | 10/1992 | Eppler | |
| 5,368,406 | A | 11/1994 | Hanshaw | |
| 6,561,710 | B1 | 5/2003 | Shamitoff | |
| 6,773,185 | B1 * | 8/2004 | Hsieh | B43K 24/04 401/109 |
| 7,128,489 | B2 | 10/2006 | Paillot et al. | |
| 8,096,722 | B2 | 1/2012 | Rolion et al. | |
| 8,434,957 | B2 * | 5/2013 | Kageyama | B43K 24/08 401/109 |
| 8,550,735 | B2 | 10/2013 | Rolion et al. | |
| 8,851,774 | B2 | 10/2014 | Rolion et al. | |
| 9,296,250 | B2 | 3/2016 | Rolion et al. | |
| 9,308,770 | B2 | 4/2016 | Goossens | |
| 10,377,166 | B2 | 8/2019 | Kim | |
| 2012/0057920 | A1 | 3/2012 | Rolion | |
| 2019/0166970 | A1 | 6/2019 | Durksz et al. | |
| 2020/0262234 | A1 | 8/2020 | Jackson | |

* cited by examiner

*Primary Examiner* — David P Angwin
*Assistant Examiner* — Bradley S Oliver
(74) *Attorney, Agent, or Firm* — Dunlap Bennett & Ludwig, PLLC

(57) ABSTRACT

An improved double-locking clicker mechanism is generally disclosed. The clicker mechanism includes a housing, plunger, and lock button. The lock button interacts with the housing such that it is capable of locking the plunger in two positions: a retracted mode and an extended mode. The clicker mechanism can couple with other elements to form a functional structure, such as forming part of a writing tool. With such a structure, the writing tool can be locked in writing and non-writing modes, providing improved safety for users thereof.

2 Claims, 4 Drawing Sheets

DOUBLE-LOCKING CLICKER MECHANISM AND USES THEREOF

BACKGROUND OF THE INVENTION

The present invention relates to mechanical clicker mechanisms for writing tools and, more particularly, to a double-locking clicker mechanism (for use with, for example, a writing tool) to prevent accidental deployment of a writing tip thereof.

Traditional clicker style pens, pencils, and the like, only require one input to deploy the writing tip (e.g., a writing portion end of an ink cartridge, a graphite lead, etc.). When this occurs, ink, graphite, or other writing mediums from the writing tool can get on unwanted items and surfaces. Further, often these tips can be relatively sharp, also posing a safety hazard when they are deployed without the intention of being used.

As can be seen, there is a need for an improved writing tool with a double-locking mechanism that prevents accidental deployments of the writing tool's tip.

SUMMARY OF THE INVENTION

In one aspect of the present invention, a clicker mechanism comprises: a housing defining: a first groove on an outer portion thereof, the first groove further defining a retraction locking shoulder, an extension locking shoulder, and a neck portion therebetween; and an axially extending housing opening through a center portion of the housing; a plunger longitudinally extending at least partially within the housing opening, defining a transverse plunger opening and being actuatable between a retracted mode and an extended mode; and a lock button slidably engaged with the plunger and transversely extending at least partially within the plunger opening, wherein the lock button selectively engages the retraction locking shoulder, in the retracted mode, and the extension locking shoulder, in the extended mode, such that movement of the plunger is prevented when the lock button engages the retraction locking shoulder and the extension locking shoulder.

In another aspect of the present invention, a writing tool comprises: a writing tool body; an ink cartridge; and a clicker mechanism comprising: a housing coupled with the writing tool body and defining: a first groove on an outer portion thereof, the first groove further defining a retraction locking shoulder, an extension locking shoulder, and a neck portion therebetween; and an axially extending housing opening through a center portion of the housing; a plunger longitudinally extending at least partially within the housing opening, defining a transverse plunger opening, being coupled with the ink cartridge, and being actuatable between a retracted mode and an extended mode to respectively retract an end of the ink cartridge and extend the end of the ink cartridge; and a lock button slidably engaged with the plunger and transversely extending at least partially within the plunger opening, wherein the lock button selectively engages the retraction locking shoulder, in the retracted mode, and the extension locking shoulder, in the extended mode, such that movement of the plunger is prevented when the lock button engages the retraction locking shoulder and the extension locking shoulder.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
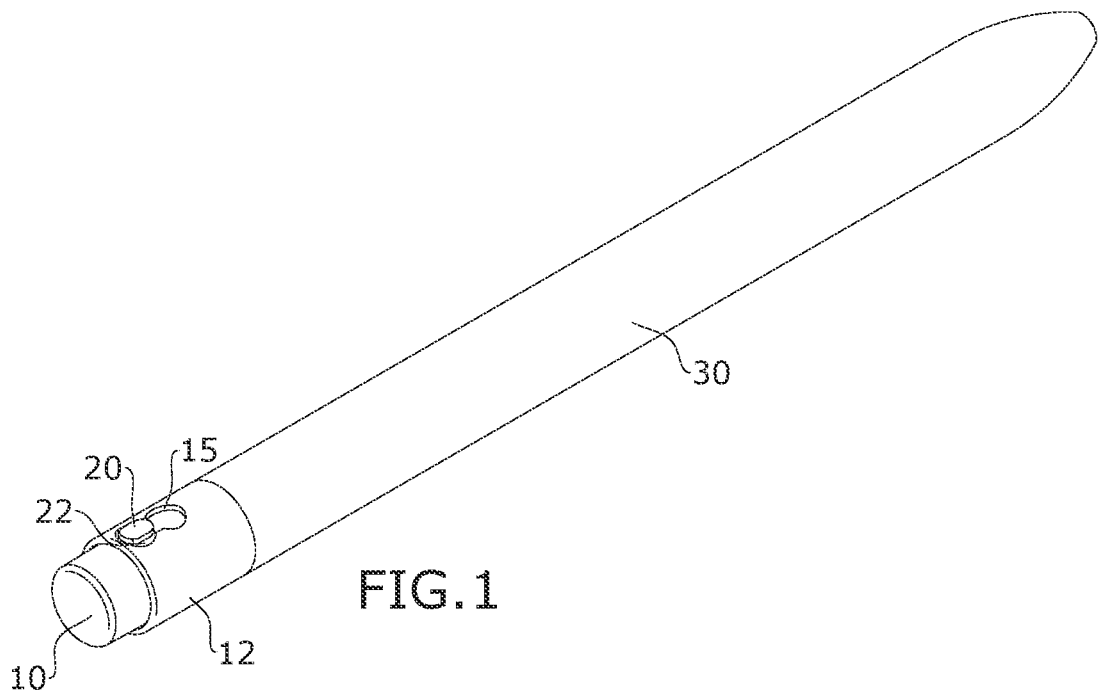
FIG. 1 is a perspective view of an embodiment of the present invention, shown in a non-writing, retracted mode.
Figure 2:
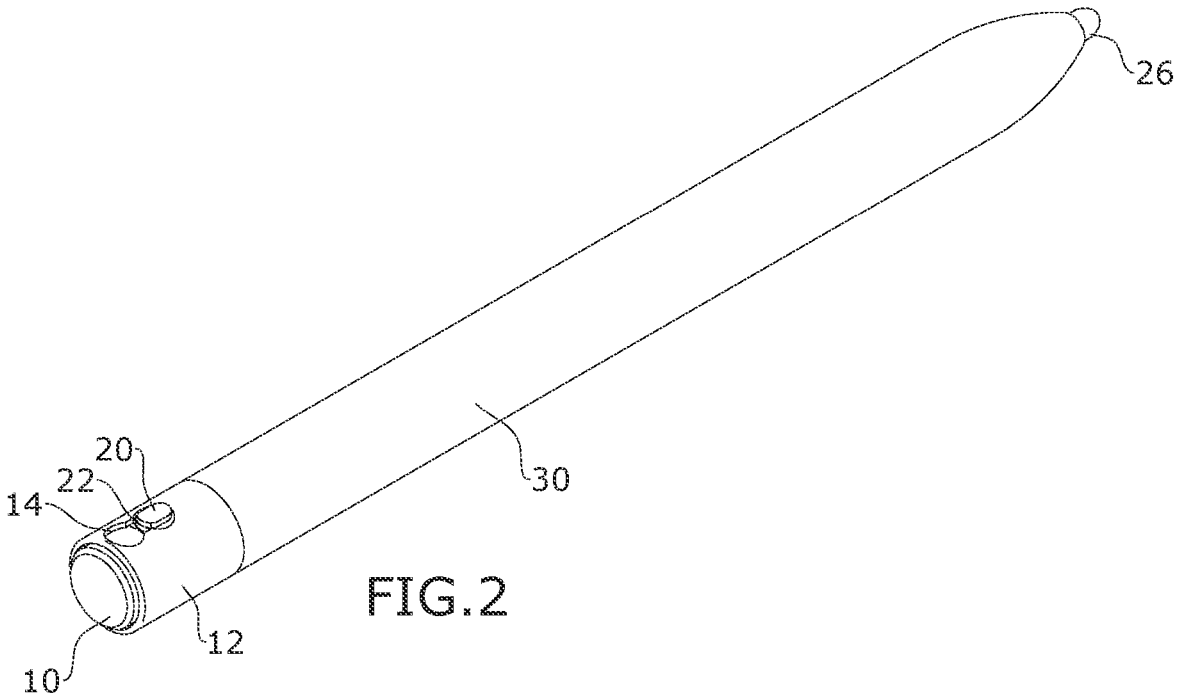
FIG. 2 is a perspective view of the embodiment of the present invention, shown in a writing, deployed mode.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details.

Broadly, one embodiment of the present invention is an improved double-locking clicker mechanism. The present invention utilizes a clicker-style mechanism that has a lock incorporated therewith. The clicker mechanism advantageously locks in both positions (the writing mode and non-writing mode). No other clicker-style pen or other writing utensil/tool has a lock for both positions and will stop accidental ink cartridge deployment.

Referring to FIGS. 1-10, a clicker-style writing tool has an outer body that includes a plunger 10, a bushing 12 (which serves as a housing for various components, as described below), and a pen body 30. As shown in FIG. 1, the plunger 10 and bushing 12 are disposed on a first side of the writing tool. While the bushing 12 is shown as a separate component, those with skill in the art will appreciate that it could also be incorporated directly into the overall pen body 30 to form a singular unit and doing so is within the spirit and scope of the present disclosure. Further, the bushing 12, as shown, is threaded onto the pen body 30, but those with skill in the art will appreciate that it may be affixed in any appropriate way. The components of the clicker mechanism (generally shown in FIG. 4) may be, in certain embodiments, formed from grade 5 titanium; however, any other appropriate material may be utilized as well. Making reference to FIG. 10, an ink cartridge 26 (or other writing medium) extends from a second side of the writing tool and is movable within the pen body 30 between retracted, non-writing and extended, writing modes. The ink cartridge 26 is biased towards a retracted position via a cartridge spring 28, as is known in the art.

Figure 3:
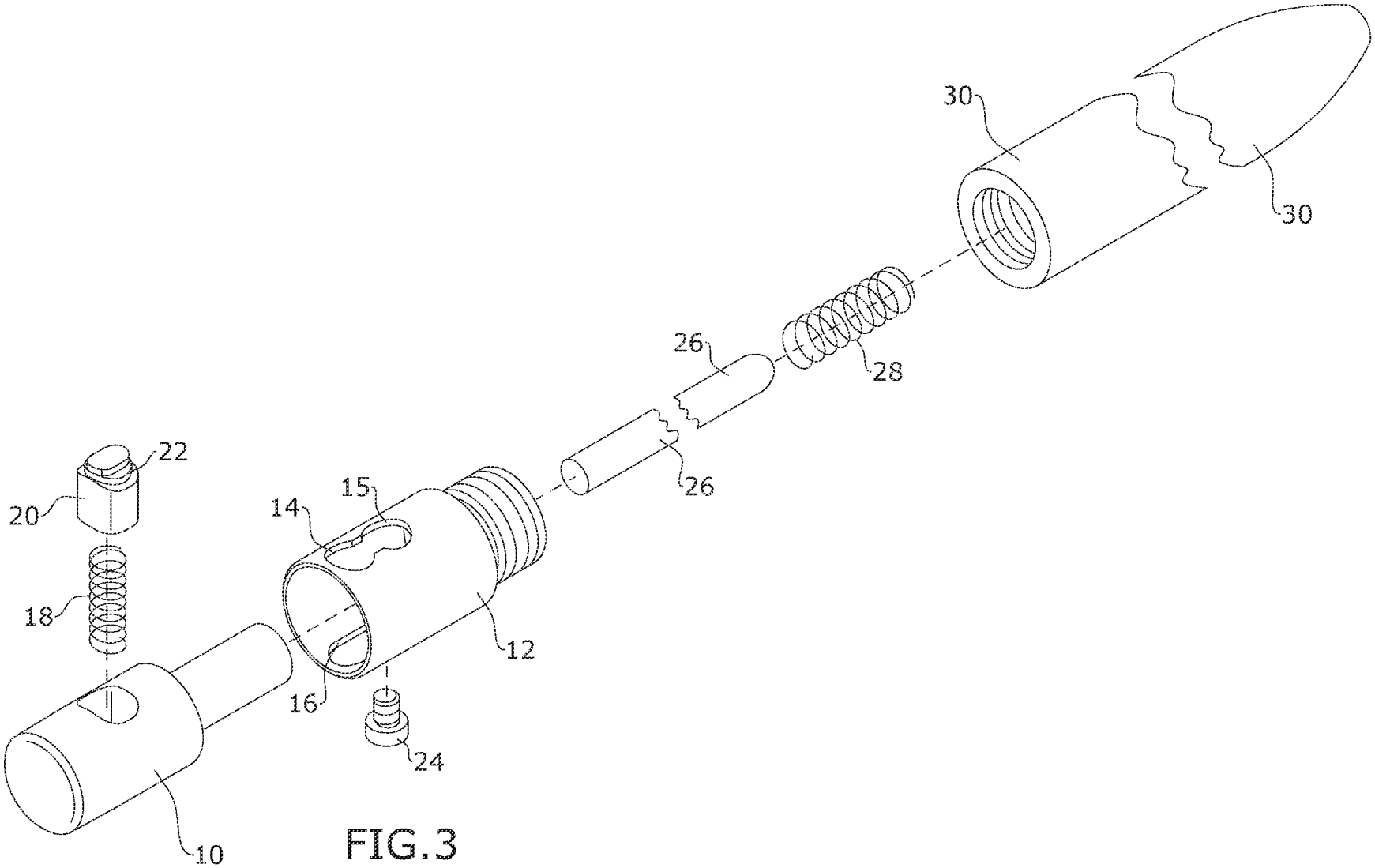
FIG. 3 is an exploded view of the embodiment of the present invention.
Figure 4:
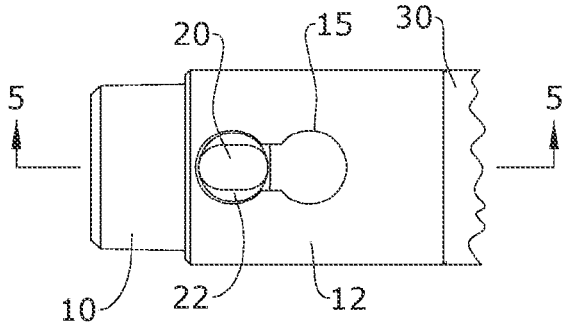
FIG. 4 is a top detail view of a clicker mechanism of the embodiment of the present invention.

Referring, for example, to FIG. 3, a groove is formed in the bushing 12 to generally define a retraction locking shoulder 14, an extension locking shoulder 15 with a narrowed down neck portion disposed therebetween, the function of the groove being described in greater detail below. As shown in FIG. 4, the shoulders 14, 15 are substantially circular in shape and the neck portion is narrower in width than the widths of the shoulders 14, 15 (thus making it a narrowed down portion of the groove). As shown in FIG. 3, a screw alignment track 16 (formed as a groove in the bushing 12) is defined on an opposite side of the bushing 12.

Figure 5:
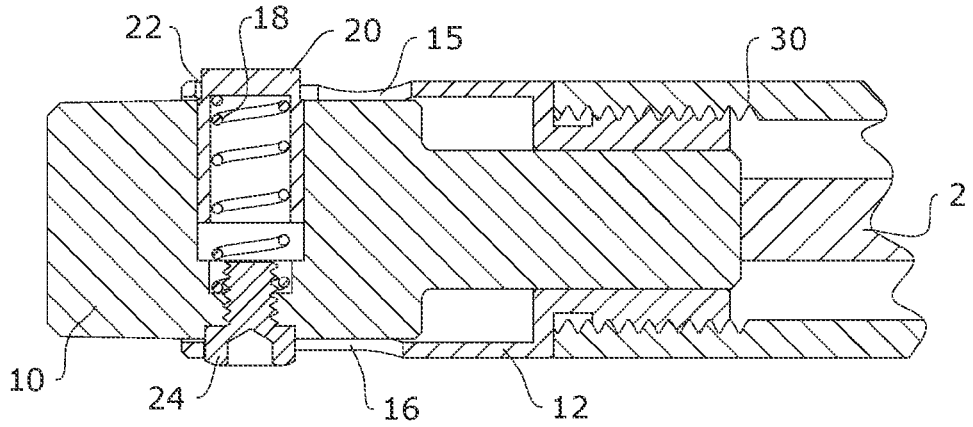
FIG. 5 is a detailed section view of the embodiment of the present invention, taken along line 5-5 in FIG. 4 and shown in the non-writing mode.
Figure 6:
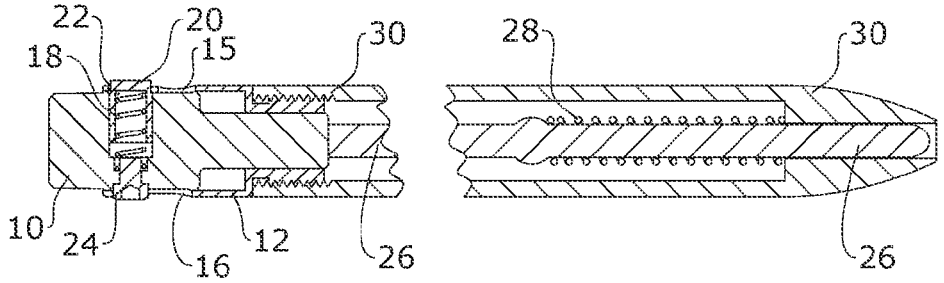
FIG. 6 is a section view of the embodiment of the present invention, taken along line 5-5 in FIG. 4 and showing an entire length of the embodiment (with the exception of a cutaway middle section)

As shown in FIG. 5, housed within a channel/cutout of the plunger 10 is a screw 24 screwably engaged therewith, a lock button 20 opposite the screw 24, and a lock button spring 18 for biasing the lock button 20 outwardly. The lock button 20 is provided with a lock button shoulder 22 for selectively being received in the retraction locking shoulder 14 and extension locking shoulder 15, as described in greater detail below. The screw 24 serves as a positive stop mechanism for both the extended and retracted positions (described in greater detail below) and helps to keep other components of the embodiment in alignment. Rather than having a screw 24 provided, other embodiments could include other hard stops formed directly into the plunger 10 and/or bushing 12, for example. Further, while the lock button spring 18 is illustrated as a coil spring, any appropriate elastic element (such as rubber) may be used in accordance with the present invention. Together, the lock button 20, lock button spring 18, screw 24, retraction locking shoulder 14 and extension locking shoulder 15 form a double-locking mechanism.

Figure 7:
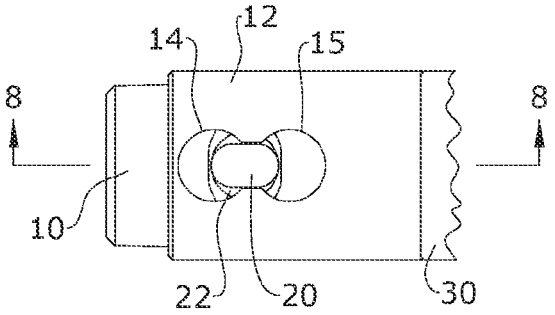
FIG. 7 is a top detail view of the clicker mechanism of the embodiment of the present invention, with a button thereof depressed and transitioning between the writing mode and the non-writing mode.
Figure 8:
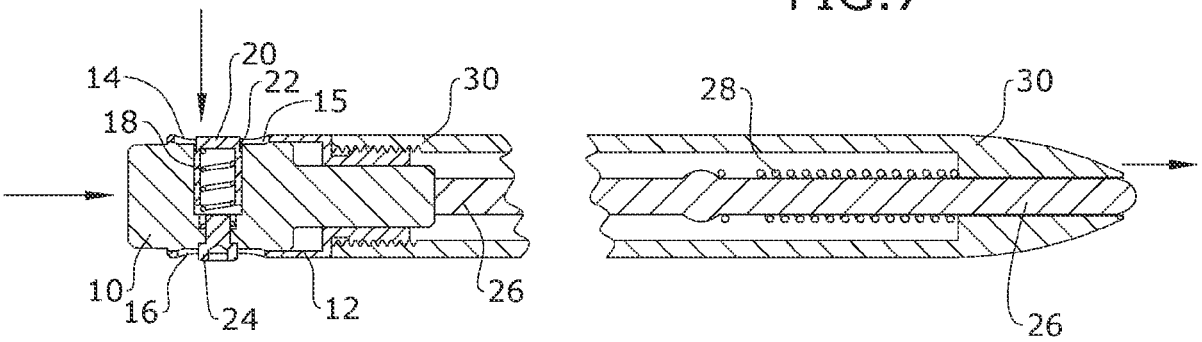
FIG. 8 is a section view of the embodiment of the present invention, taken along line 8-8 in FIG. 7, with arrows included to show directional movement of components of the embodiment.

FIGS. 4-10 illustrate actuation of the writing tool between the retracted mode (FIGS. 4-6) and a deployed mode (FIGS. 9 and 10), with FIGS. 7 and 8 illustrating a transitional state of the double-locking mechanism. In the retracted mode, the plunger 10 extends from the bushing 12 on an exposed end of the bushing 12. In this position, the shoulder 22 of the lock button 20 is biased outwardly by the lock button spring 18 to nest with the retraction locking shoulder 14 to maintain the plunger 10 in the extended position and, consequently, prevent the ink cartridge 26 (which is coupled to the plunger 10) from moving out of the pen body 30. Thus, the lock button 20, plunger 10, and ink cartridge 26 are locked in place.

As shown in FIG. 8, indicated by the downwards pointing directional arrow, to unlock the lock button 20, plunger 10, and ink cartridge 26, the lock button 20 is pressed downwardly, compressing the spring 18 and retracting the lock button 20 into the channel formed in the plunger 10. This action releases the shoulder 22 from the retraction locking shoulder 14 and allows the plunger 10 to move freely in a longitudinal direction (as indicated by the rightward pointing directional arrow). Accordingly, after a user depresses the lock button 20, the user can press the plunger 10 inwardly to move the ink cartridge 26 towards the extended mode. Because the lock button nests in the channel formed in the plunger 10, it also rides along therewith as the plunger 10 moves longitudinally. As shown in FIG. 7, an outermost portion of the lock button 20 is pill-shaped, which permits it to slide between a narrowed down neck portion (disposed between shoulders 14, 15) of the groove formed in the bushing 12 while it is depressed by the user.

Figure 9:
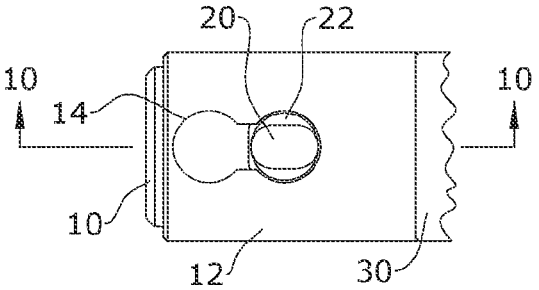
FIG. 9 is a top detail view of the clicker mechanism of the embodiment of the present invention, shown in the writing mode.
Figure 10:
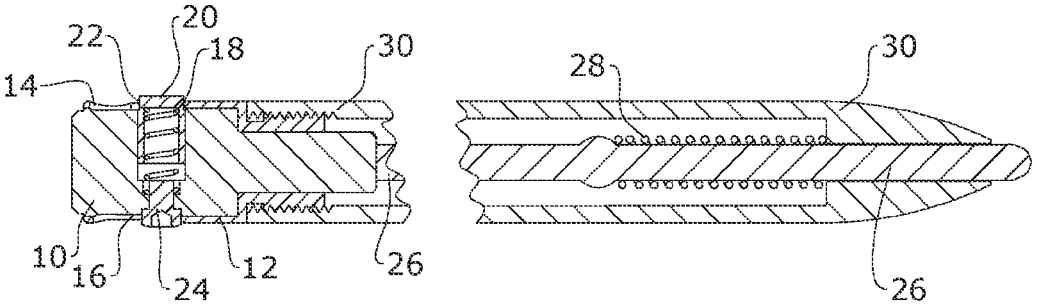
FIG. 10 is a section view of the embodiment of the present invention, taken along line 10-10 in FIG. 9 and showing the entire length of the embodiment (with the exception of the cutaway middle section).

Once the plunger 10 is pushed to its travel limit, as shown in FIGS. 9 and 10, the lock button 20 may be released by the user. The spring 18 biases the lock button 20 upwardly into the extension locking shoulder 15, locking the ink cartridge 26 in the extended mode, at which point the plunger 10 can be released by the user.

To retract the ink cartridge 26, the reverse steps may be employed. The lock button 20 is depressed by the user until the shoulder 22 is clear of the extension locking shoulder 15. At this point, the cartridge spring 28 retracts the ink cartridge 26 back fully into the pen body 30 and urges the plunger 10 outwardly (since the plunger 10 and ink cartridge 26 move in unison). Once the plunger reaches its outwards travel limit, the shoulder 22 aligns with the retraction locking shoulder 14 and the lock button 20 is again biased upwardly such that the shoulder 22 engages the retraction locking shoulder 14. Thus, the double-locking mechanism described herein permits the writing tool to be selectively locked in two positions, with the act of extending the ink cartridge 26 requiring two actions from the user (pressing the lock button 20 and also the plunger 10). As is readily apparent, the requirement of two actions better prevents accidental deployments of the ink cartridge 26.

The clicker mechanism described herein may be used the same manner as a standard clicker style mechanism, but the present invention has the additional benefit of safety due to the lock button 20. By having to do two actions to extend the ink cartridge 26, it makes this mechanism a safer mechanism to use. Further, those with skill in the art will appreciate that this clicker mechanism may be usable with various applications such as: ink pens (as described), pencils, pen knives, markers, and laser pointers.

Various appropriate methods may be used to form embodiments of the present invention. Four components of this clicker mechanism may be machined on computer numeric control (CNC) machining and CNC Turning Centers: the bushing 12, plunger 10, lock button 20, and screw 24. They could also be made on manual milling machines and manual turning lathes. These parts could also be casted and or molded from various materials. The spring 18 inside the mechanism to made for us on a spring making machine. Other components of the writing tool may be formed using known techniques for writing tool manufacturing.

While one or more preferred embodiments are disclosed, many other implementations will occur to one of ordinary skill in the art and are all within the scope of the invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

While apparatuses and methods are described in terms of "comprising," "containing," or "including" various components or steps, the apparatuses and methods can also "consist essentially of" or "consist of" the various components and steps. All numbers and ranges disclosed above may vary by some amount.

Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

If used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A clicker mechanism comprising:

a housing defining:

a first groove on an outer portion thereof, the first groove further defining a retraction locking shoulder, an extension locking shoulder, and a neck portion therebetween; and an axially extending housing opening through a center portion of the housing;

a plunger longitudinally extending at least partially within the housing opening, defining a transverse plunger opening and being actuatable between a retracted mode and an extended mode; and a lock button slidably engaged with the plunger and transversely extending at least partially within the plunger opening, wherein the lock button selectively engages the retraction locking shoulder, in the retracted mode, and the extension locking shoulder, in the extended mode, such that movement of the plunger is prevented when the lock button engages the retraction locking shoulder and the extension locking shoulder, wherein the clicker mechanism further comprises a screw fixedly coupled to the plunger, and wherein the housing further comprises a second groove, opposite the first groove, that the screw is configured to ride in when the plunger moves between the retracted mode and the extended mode.

2. The clicker mechanism of claim 1, wherein the housing is configured to couple with a writing tool body, and the plunger is configured to couple with an ink cartridge.

* * * * *